US005938046A

United States Patent [19]

Joachim

[11] Patent Number: 5,938,046

[45] Date of Patent: Aug. 17, 1999

[54] AIR SEPARATION GRADER

[75] Inventor: Galk Joachim, Lohmar, Germany

[73] Assignee: Hosokawa MikroPul GmbH, Germany

[21] Appl. No.: 08/930,900

[22] PCT Filed: Apr. 10, 1996

[86] PCT No.: PCT/EP96/01536

§ 371 Date: Feb. 6, 1998

§ 102(e) Date: Feb. 6, 1998

[87] PCT Pub. No.: WO96/32204

PCT Pub. Date: Oct. 17, 1996

[30] Foreign Application Priority Data

Apr. 11, 1995 [DE] Germany ..... 195 13 745

[51] Int. Cl.[6] ..... B04B 5/12; B07B 4/00; B07B 7/02; B07B 7/04

[52] U.S. Cl. ..... 209/714; 209/142; 209/143; 55/409

[58] Field of Search ..... 55/408, 409; 209/142, 209/143, 146, 713, 714

[56] References Cited

U.S. PATENT DOCUMENTS

| | | | |
|---|---|---|---|
| 2,914,172 | 11/1959 | Lykken et al. | 209/714 |
| 2,915,179 | 12/1959 | Lykken | 209/714 |
| 3,767,045 | 10/1973 | Voelskow | 209/714 |
| 4,919,795 | 4/1990 | Fujii et al. | 209/714 |

FOREIGN PATENT DOCUMENTS

| | | | |
|---|---|---|---|
| 628291 | 4/1936 | Germany | 209/713 |
| 973572 | 3/1960 | Germany . | |
| 48499 | 9/1966 | Germany . | |
| 42 34 440 | 4/1994 | Germany . | |
| 43 26 604 | 2/1995 | Germany . | |
| 40 25 458 | 11/1995 | Germany . | |
| 195 13 745 | 6/1996 | Germany . | |

*Primary Examiner*—William E. Terrell
*Assistant Examiner*—Joe Dillon, Jr.
*Attorney, Agent, or Firm*—Wall Marjama Bilinski & Burr

[57] ABSTRACT

The invention relates to a grader which employs an air separation principle. The grader includes a rotor rotatably supported in a housing. The rotor includes a pair of rotor disks on its outer boundaries extending radially substantially to the housing. A plurality of blades are disposed on the rotor between the rotor disks. A circumferential channel is formed by the rotor disks, the housing and the plurality of blades. The bladed rotor functions as a vertical sink in order to grade a solid which is fed into the circumferential channel via a tangential passage.

8 Claims, 2 Drawing Sheets

FIG.3
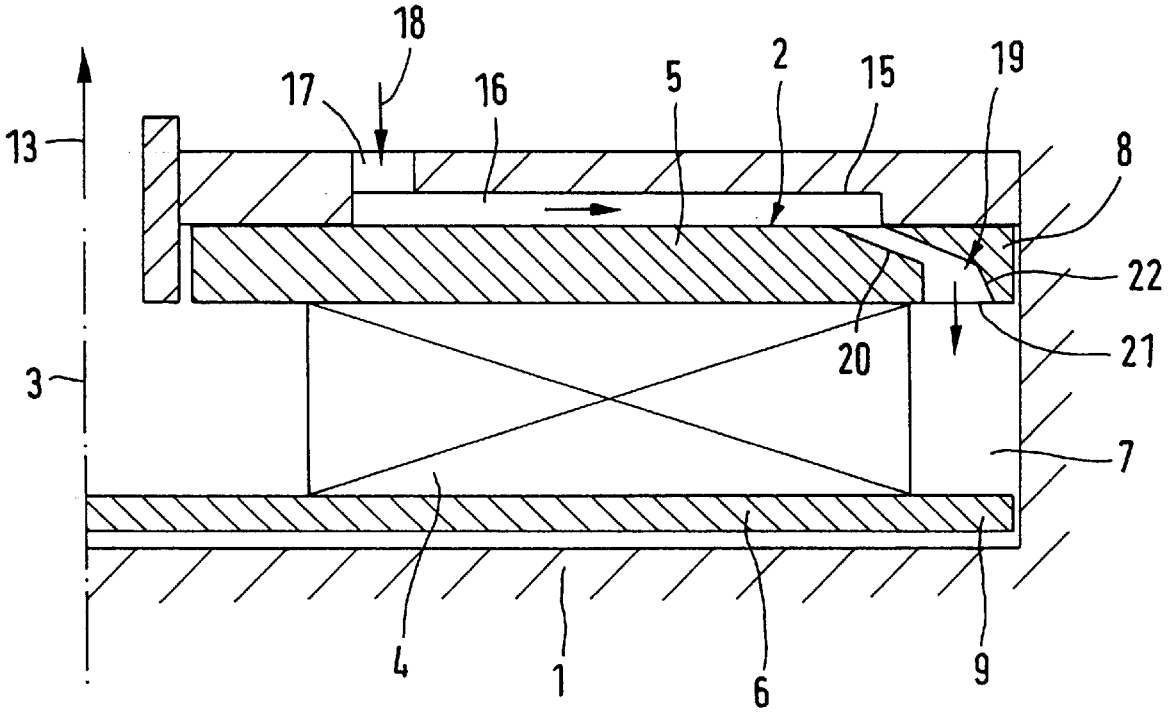
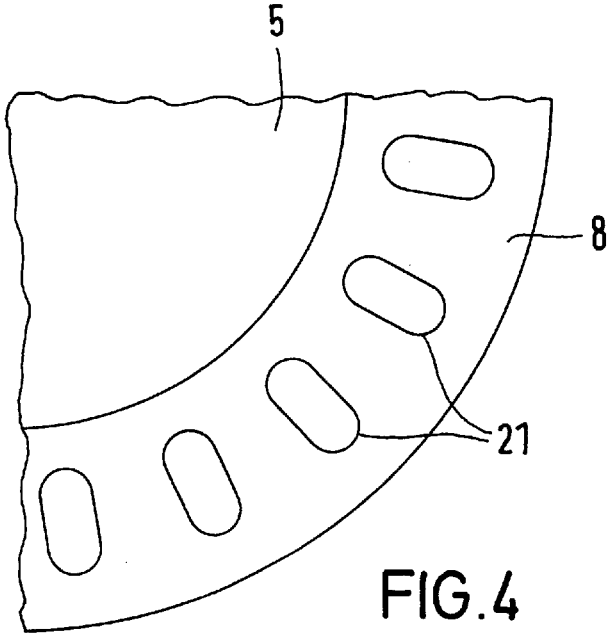
FIG.4

AIR SEPARATION GRADER

BACKGROUND OF THE INVENTION

The invention relates to a grader based on the air separation principle.

SUMMARY OF INVENTION

In graders of this type the bladed rotors serve for the realization of a forced vortical sink flow. The form of the rotors can be cylindrical or conical and the blades or rotor vanes can have different forms and setting angles. The solid to be graded and the fluid (gas or liquids) are emplaced together (as an aerosol or suspension) or separately. Within the rotor a motion component in the circumferential or tangential direction is impressed onto the flow by the blades and the adjacent pipe [SIC: rotor] disks. Due to the effect of the forces directed a in the opposite direction—centrifugal, or radial force, sweeping force of the fluid—the desired gradation takes place.

Independently of whether or not the fluid used is a gas or a liquid, in graders of this type optimum flow conditions are a fundamental prerequisite, especially for the discrimination of the gradation.

In known air separators the rotor disks extend up to the outer circumference of the blading. The channel serving for the feed of the solid and the fluid in these air separators is encompassed on three sides by the housing and on one side by the outer circumference of the rotor. The stationary portion of the inner walls of the outer channel, thus the region which has a braking effect on product-fluid flow, is thus relatively large. This leads to friction losses and to the development of secondary flows, thus to flow turbulences which impair the quality of the gradation.

The present invention is based on the task of creating a grader of the above cited type, in which the described turbulences impairing the quality of the gradation are minimized.

According to the invention this task is solved with the characterizing features of the patent claims. In a grader with these characteristics the outer channel serving for the feed of solid and fluid is encompassed on three sides by mutually rotating walls. This leads to the following advantages:

- Strong braking of the flow in the circumferential direction which leads to a more rapid decrease of the circumferential velocity and which exerts a disadvantageous effect on the gradation is avoided,
- Development of a secondary flow on the upper and lower stationary boundary wall is prevented,
- Friction losses due to the large velocity gradient in the circumferential direction between stationary housing wall and rotating fluid/solid are decreased or even avoided such that the pressure loss is minimized,
- Due the feed at identical velocity of fluid and/or solid a further braking of the flow as well as also the minimization of the flow turbulence is attained which is caused by the pulse exchange between fluid and solid.

BRIEF DESCRIPTION OF THE DRAWINGS

Further advantages and details of the invention will be explained in conjunction with the embodiment examples depicted schematically in FIGS. 1 to 4. Therein show.

DESCRIPTION OF THE INVENTION

In all Figures the housing of the grader is denoted by 1, the rotor by 2, its axis of rotation by 3, its blading by 4, the rotor disks enclosing the blading 4 by 5 and 6, and the outer channel by 7. The diameter of the rotor disks are such that their outer edges 8 and 9 extend into the channel 7 and form lateral boundaries of the channel 7.

Figure 1:
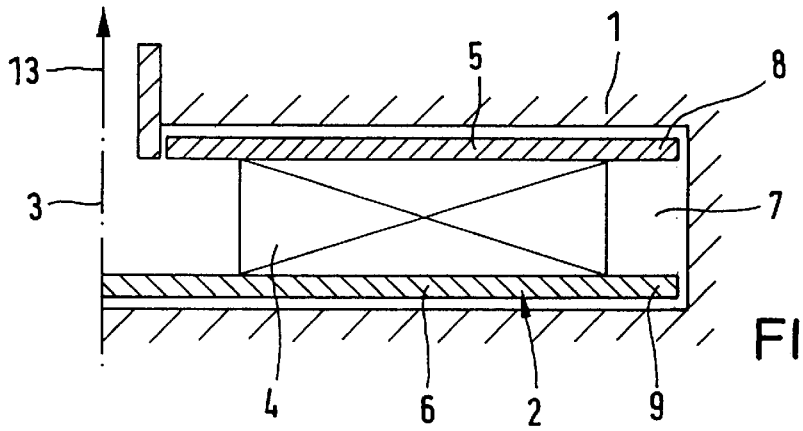
FIG. 1 and 2 partial sections through a rotor according to the invention with tangential solid/fluid feed, FIG. 3 a partial section through a rotor with axially parallel solid/fluid feed, and FIG. 4 a top view onto openings serving in the embodiment example according to FIG. 3 for the solid/fluid feed.
Figure 2:
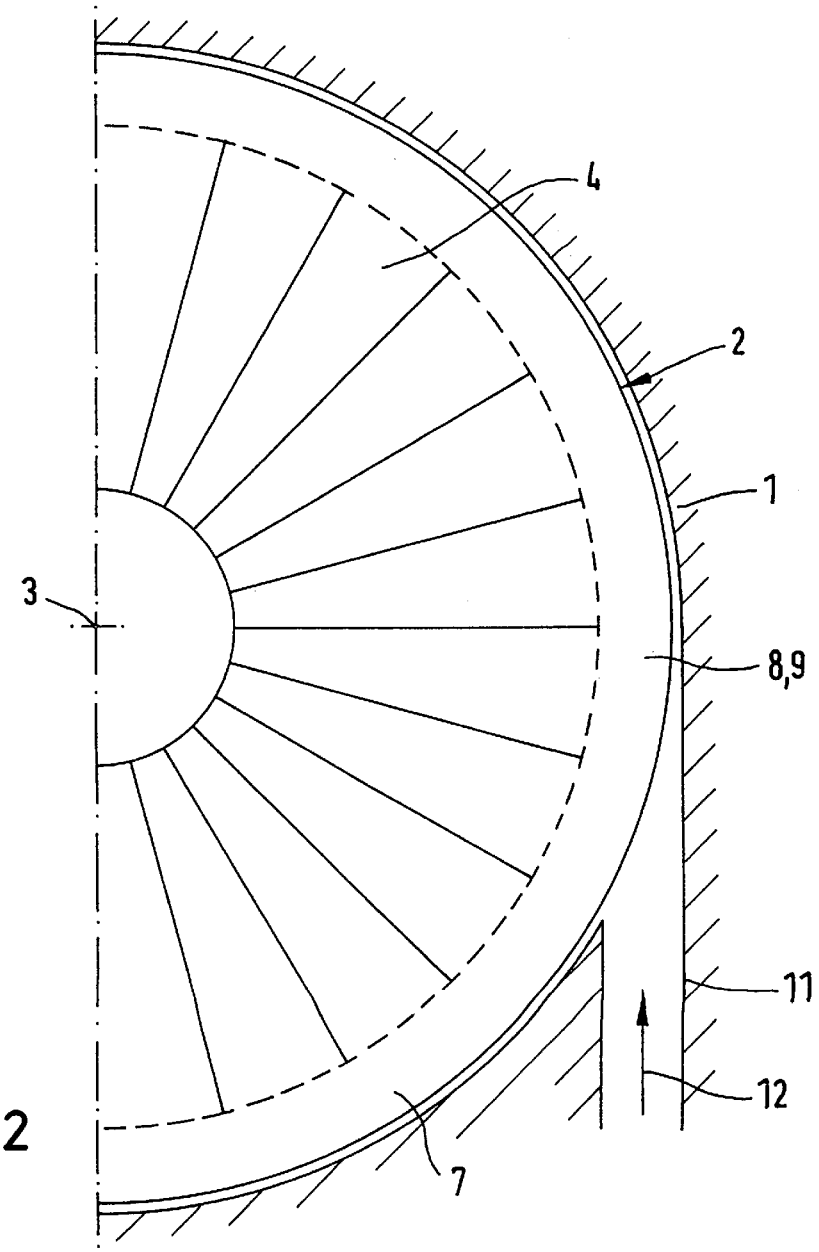

In the embodiment example according to FIGS. 1 and 2 the feed of solid and fluid takes place via a tangentially directed inlet (inlet ports 11 with an arrow 12 in FIG. 2). In the separating zone (channel 7) and in the rotor 2 the gradation takes place. The coarse material leaves the channel 7 via a (not shown) outlet. The fine material flows through the rotor 2 from the outside inwardly and leaves the grader in the axial direction (arrow 13 in FIG. 1).

The embodiment example according to FIGS. 3 and 4 differs from the embodiment example according to FIGS. 1 and 2 with respect to the solid feed. In the region of the upper rotor disk 5 the housing 1 is equipped with an annular cutout 15 which, together with the upper rotor disk 5, forms an annular chamber 16 extending approximately to the outer edge 8. The feed of the solid or also of an aerosol (or a suspension) takes place via an inlet 17 disposed radially inward (arrow 18). On its path toward the outside the supplied material is already accelerated in the circumferential direction. It leaves the chamber 16 via a multiplicity of perforations 19 implemented in the rotor disk 5 or its outer edge 8. In the embodiment example depicted the perforations terminate in the separating zone (channel 7).

The perforations 19 are implemented such that a section of line 20 adjoins the chamber 15, which [section] initially extends obliquely outwardly and in the direction toward channel 7. This [section] extends via an essentially axially parallel section of line 22 which widens to form a port 21 which is elongated in the radial direction.

FIG. 4 depicts a top view onto a portion of the underside of the rotor disk 5 or its edge 8. It is evident that the sections of line 22 widen to form elongated, approximately oval, ports 21. The supplied material obtains in the perforations 19 the circumferential velocity corresponding to the radius of the site of the ports 21.

Whether or not the solid to be graded is introduced independently of the fluid, with a portion of the fluid or together with the fluid into the gradation region (channel 7), depends substantially on the properties of the solid. Both embodiment examples permit all alternatives. In the embodiment example according to FIGS. 3 and 4 the option is also given of disposing the ports 21 on a smaller radius such that the sections of line 19 [SIC] terminate between the buckets 4 into the rotor 2.

I claim:

1. A grader employing an air separation principle for grading solids that includes:

a housing having an inner radial wall;

a rotor mounted for rotation within a chamber formed in said housing, said rotor containing a pair of spaced apart disks and blades disposed between said disks;

said blades being capable of supplying both a centripetal and a circumferential force on the solids to be graded;

said housing further containing an outer circumferential channel about the periphery of the rotor through which solid and fluid materials can be moved, the outer circumferential channel being defined laterally by said disks and radially by the blades and the housing, said channel including three mutually rotating boundaries and having a uniform cross section; and said disks each having a diameter such that the outer periphery of each disk extends radially beyond said blades into said channel substantially to the inner radial wall of said housing to form lateral boundaries for said channel.

2. The grader of claim 1 wherein said housing further includes a passage that is tangentially connected to said channel.

3. The grader of claim 1 wherein one of said disks contains perforations therein through which solid and fluid materials can pass.

4. The grader of claim 3 wherein said perforations are disposed about the outer section of said one disk.

5. The grader of claim 4 wherein said housing has an annular cutout into which the perforations open.

6. The grader of claim 5 wherein said housing has an inlet formed therein that passes into the inner edge of the cutout and said perforations opening along the outer edge of the cutout.

7. The grader of claim 6 wherein the perforations contain two sections, a first section extending obliquely within the disk and opening into said cutout and a second section that diverges toward said channel from said first section.

8. The grader of claim 7 wherein said second section of each perforation contains an oval shaped port that opens into said channel.

* * * * *